US010370067B2

(12) United States Patent
Jakopin

(10) Patent No.: US 10,370,067 B2
(45) Date of Patent: Aug. 6, 2019

(54) DIVE PLATFORM SYSTEM

(71) Applicant: Japec Jakopin, Ljubljana (SI)

(72) Inventor: Japec Jakopin, Ljubljana (SI)

( * ) Notice: Subject to any disclaimer, the term of this patent is extended or adjusted under 35 U.S.C. 154(b) by 0 days.

(21) Appl. No.: 15/897,523

(22) Filed: Feb. 15, 2018

(65) Prior Publication Data

US 2018/0229815 A1 Aug. 16, 2018

Related U.S. Application Data

(60) Provisional application No. 62/578,746, filed on Oct. 30, 2017.

(30) Foreign Application Priority Data

Feb. 15, 2017 (SI) ..... 201700049

(51) Int. Cl.

| | |
|---|---|
| ***B63B 3/48*** | (2006.01) |
| ***B63B 27/00*** | (2006.01) |
| ***B63H 20/00*** | (2006.01) |
| ***B63B 27/14*** | (2006.01) |
| ***B63B 27/36*** | (2006.01) |

(Continued)

(52) U.S. Cl.

CPC ..... *B63B 27/02* (2013.01); *B63B 3/48* (2013.01); *B63B 27/14* (2013.01); *B63B 27/36* (2013.01); *B63H 20/00* (2013.01); *B63H 20/10* (2013.01); *B63B 2009/008* (2013.01); *B63B 2029/022* (2013.01); *B63H 2020/003* (2013.01)

(58) Field of Classification Search

CPC ..... B63B 27/02; B63B 3/48
USPC ..... 114/362
See application file for complete search history.

(56) References Cited

U.S. PATENT DOCUMENTS 3,209,663 A 10/1965 Baier
4,824,067 A * 4/1989 O'Brien ..... B63H 20/10 248/642

(Continued)

FOREIGN PATENT DOCUMENTS

CH 702460 A2 6/2011
DE 202009007144 U1 8/2009

(Continued)

OTHER PUBLICATIONS

Notice of Allowance issued in U.S. Appl. No. 15/897,494 dated Jul. 20, 2018.
Non-Final Office Action issued in U.S. Appl. No. 15/897,423 dated Jul. 20, 2018.
Non-Final Office Action issued in U.S. Appl. No. 15/897,445 dated Jul. 20, 2018.

(Continued)

*Primary Examiner* — Stephen P Avila
(74) *Attorney, Agent, or Firm* — Brian J. Colandreo; Jeffrey T. Placker; Holland & Knight LLP

(57) ABSTRACT

An aft-mounted dive platform system includes at least one hull portion rigidly affixed to a hull of a boat. A dive platform is coupled to the at least one hull portion and is positioned, at least partially, behind at least one propeller drive system affixed to the stern of the boat. The at least one hull portion includes a first hull portion and a second hull portion. The first hull portion includes: a first inner portion surface positioned proximate a first side of the at least one propeller drive system and a first outer portion surface positioned proximate a first outer surface of the hull of the boat; wherein the first outer portion surface of the first hull portion is recessed with respect to the first outer surface of the hull of the boat.

20 Claims, 8 Drawing Sheets

(51) Int. Cl.

| | |
|---|---|
| ***B63H 20/10*** | (2006.01) |
| *B63B 9/00* | (2006.01) |
| *B63B 29/02* | (2006.01) |

(56) References Cited

U.S. PATENT DOCUMENTS

| | | | | |
|---|---|---|---|---|
| 5,544,606 | A | 8/1996 | Schmidt, Jr. | |
| 7,162,969 | B2 * | 1/2007 | Houlder | B63B 27/14 114/362 |
| 8,826,845 | B2 * | 9/2014 | Mochizuki | B63B 3/48 114/362 |
| 2010/0186657 | A1 | 7/2010 | Muller | |
| 2011/0023770 | A1 | 2/2011 | Brown | |
| 2012/0028517 | A1 | 2/2012 | Mochizuki et al. | |
| 2013/0160695 | A1 | 6/2013 | Gratz et al. | |
| 2014/0378014 | A1 | 12/2014 | Minoura | |
| 2015/0203177 | A1 * | 7/2015 | Mueller | B63B 27/146 114/285 |

FOREIGN PATENT DOCUMENTS

| | | | |
|---|---|---|---|
| DE | 202009007140 | U1 | 9/2009 |
| DE | 202010004388 | U1 | 8/2010 |
| DE | 202011001767 | U1 | 5/2011 |
| WO | 2009006753 | A1 | 1/2009 |
| WO | 2015132725 | A1 | 9/2015 |

OTHER PUBLICATIONS

Non-Final Office Action issued in U.S. Appl. No. 15/897,505 dated Jul. 20, 2018.

Non-Final Office Action issued in U.S. Appl. No. 15/897,461 dated Jul. 20, 2018.

https://web.archive.org/web/20160208145809/http://www.valdenassi.com/inglese/prodotti/titoli.carabotingl/planc_poppa_uk.htm.

International Search Report issued in Application Serial No. PCT/EP2018/053841 dated Jun. 11, 2018.

International Search Report issued in Application Serial No. PCT/EP2018/053833 dated Jun. 11, 2018.

International Search Report issued in Application Serial No. PCT/EP2018/053836 dated Jun. 4, 2018.

International Search Report issued in Application Serial No. PCT/EP2018/053842 dated Jun. 6, 2018.

International Search Report issued in Application Serial No. PCT/EP2018/053844 dated Jun. 6, 2018.

International Search Report issued in Application Serial No. PCT/EP2018/053846 dated Jun. 1, 2018.

Final Office Action issued in U.S. Appl. No. 15/897,423 dated Dec. 21, 2018.

Final Office Action issued in U.S. Appl. No. 15/897,445 dated Dec. 21, 2018.

Final Office Action issued in U.S. Appl. No. 15/897,505 dated Dec. 21, 2018.

Final Office Action issued in U.S. Appl. No. 15/897,461 dated Dec. 21, 2018.

* cited by examiner

DIVE PLATFORM SYSTEM

RELATED APPLICATION(S)

The subject application claims the priority of Slovenian Patent Application No. P-201700049, filed on 15 Feb. 2017. This application also claims the benefit of U.S. Provisional Application No. 62/578,746, filed on 30 Oct. 2017; their entire contents of which are incorporated herein by reference.

TECHNICAL FIELD

This disclosure relates to dive platform systems and, more particularly, to adjustable height dive platform systems.

BACKGROUND

Boating is a multi-billion dollar industry that millions of people around the world enjoy, providing people with a means to venture off to spend time on the water and escape everyday life. As would be expected, many boats are used for activities that require people to get into (and get out of) the water while the boat is not docked. Examples of such activities include but are not limited to swimming, tubing, kayaking, and the use of personal watercraft.

Typically, people enter and leave the boat proximate the stern. Unfortunately, many boats utilize outboard (or inboard/outboard) propulsion systems that position the propellers of the boat behind the stern, wherein these propeller are in a position that could potentially pose a danger for people entering and exiting the boat proximate the stern.

SUMMARY OF DISCLOSURE

Invention #6

In one implementation, an aft-mounted dive platform system includes at least one hull portion rigidly affixed to a hull of a boat. A dive platform is coupled to the at least one hull portion and is positioned, at least partially, behind at least one propeller drive system affixed to the stern of the boat. The at least one hull portion includes a first hull portion and a second hull portion. The first hull portion includes: a first inner portion surface positioned proximate a first side of the at least one propeller drive system and a first outer portion surface positioned proximate a first outer surface of the hull of the boat; wherein the first outer portion surface of the first hull portion is recessed with respect to the first outer surface of the hull of the boat.

One or more of the following features may be included. The dive platform may be configured to be slidably attached to the at least one hull portion, thus allowing for essentially vertical displacement of the dive platform with respect to the at least one hull portion. The first hull portion may be positioned proximate a first side of the dive platform. The first hull portion may be positioned proximate a first side of the at least one propeller drive system. The first hull portion may further include a first lower portion surface positioned proximate a first bottom surface of the hull of the boat. The first lower portion surface of the first hull portion may be recessed with respect to the first bottom surface of the hull of the boat. The second hull portion may be positioned proximate a second side of the dive platform. The second hull portion may be positioned proximate a second side of the at least one propeller drive system. The second hull portion may include a second inner portion surface positioned proximate a second side of the at least one propeller drive system, and a second outer portion surface positioned proximate a second outer surface of the hull of the boat. The second outer portion surface of the second hull portion may be recessed with respect to the second outer surface of the hull of the boat. The second hull portion may further include a second lower portion surface positioned proximate a second bottom surface of the hull of the boat. The second lower portion surface of the second hull portion may be recessed with respect to the second bottom surface of the hull of the boat. The at least one propeller drive system may be a portion of an outboard motor. The at least one propeller drive system may be an outdrive system. The dive platform may be configured to allow for the vertical passage of water through the dive platform. At least a portion of the dive platform may be constructed of a water permeable grate structure that is configured to allow for the vertical passage of water through the dive platform.

In another implementation, an aft-mounted dive platform system incudes at least one hull portion rigidly affixed to a hull of a boat. A dive platform is coupled to the at least one hull portion and is positioned, at least partially, behind at least one propeller drive system affixed to the stern of the boat. The at least one hull portion includes a first hull portion and a second hull portion. The first hull portion includes a first inner portion surface positioned proximate a first side of the at least one propeller drive system and a first outer portion surface positioned proximate a first outer surface of the hull of the boat. The first outer portion surface of the first hull portion is recessed with respect to the first outer surface of the hull of the boat. The second hull portion includes a second inner portion surface positioned proximate a second side of the at least one propeller drive system and a second outer portion surface positioned proximate a second outer surface of the hull of the boat. The second outer portion surface of the second hull portion is recessed with respect to the second outer surface of the hull of the boat. The dive platform is configured to be slidably attached to the at least one hull portion, thus allowing for essentially vertical displacement of the dive platform with respect to the at least one hull portion.

One or more of the following features may be included. The first hull portion may further include a first lower portion surface positioned proximate a first bottom surface of the hull of the boat> The first lower portion surface of the first hull portion may be recessed with respect to the first bottom surface of the hull of the boat.

In another implementation, an aft-mounted dive platform system includes at least one hull portion rigidly affixed to a hull of a boat. A dive platform is coupled to the at least one hull portion and is positioned, at least partially, behind at least one propeller drive system affixed to the stern of the boat. The at least one hull portion includes a first hull portion and a second hull portion. The first hull portion includes a first inner portion surface positioned proximate a first side of the at least one propeller drive system and a first outer portion surface positioned proximate a first outer surface of the hull of the boat. The first hull portion is positioned proximate a first side of the dive platform. The first outer portion surface of the first hull portion is recessed with respect to the first outer surface of the hull of the boat. The second hull portion includes a second inner portion surface positioned proximate a second side of the at least one propeller drive system and a second outer portion surface positioned proximate a second outer surface of the hull of the boat. The second hull portion is positioned proximate a second side of the dive platform. The second outer portion surface of the second hull portion is recessed with respect to the second outer surface of the hull of the boat.

One or more of the following features may be included. The dive platform may be configured to be slidably attached to the at least one hull portion, thus allowing for essentially vertical displacement of the dive platform with respect to the at least one hull portion.

The details of one or more implementations are set forth in the accompanying drawings and the description below. Other features and advantages will become apparent from the description, the drawings, and the claims.

BRIEF DESCRIPTION OF THE DRAWINGS

Like reference symbols in the various drawings indicate like elements.

DETAILED DESCRIPTION OF THE PREFERRED EMBODIMENTS

Figure 1:
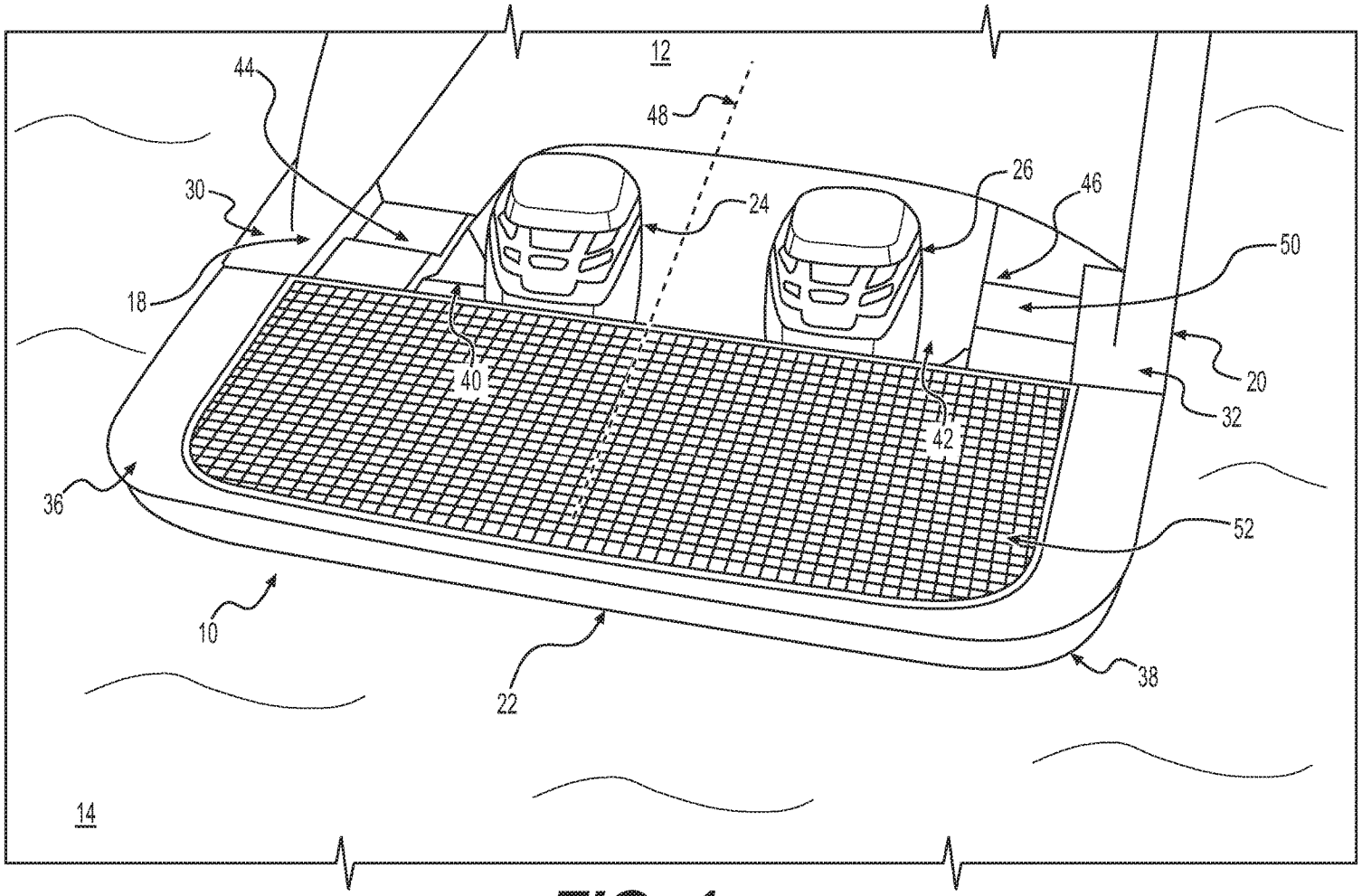
FIG. 1 is a perspective view of an aft-mounted dive platform system in a fully-raised position.

Referring to FIGS. 1-6, there is shown various diagrammatic views aft-mounted dive platform system 10 installed on/included within boat 12 that is shown floating upon/positioned within body of water 14.

Aft-mounted dive platform system 10 may include at least one hull portion that may be rigidly affixed to hull 16 of boat 12. For example, aft-mounted dive platform system 10 may include a plurality of hull portions. While the following discussion concerns aft-mounted dive platform system 10 including two hull portions (e.g., first hull portion 18 and second hull portion 20), this is for illustrative purposes only and is not intended to be a limitation of this disclosure, as other configurations are possible and are considered to be within the scope of this disclosure. For example, aft-mounted dive platform system 10 may be configured to include a single "centrally-located" hull portion. Alternatively, aft-mounted dive platform system 10 may include three or more hull portions. For the following discussion, these hull portion(s) (e.g., first hull portion 18 and/or second hull portion 20) may be any portion of hull 16 or any attachments/extensions/protrusions rigidly attached thereto.

Aft-mounted dive platform system 10 may include dive platform 22 that may be coupled to the at least one hull portion (e.g., first hull portion 18 and second hull portion 20) and may be positioned, at least partially, behind at least one propeller drive system affixed to the stern of boat 12.

While the following discussion and the related figures concern the at least one propeller drive system including a pair of outboard motors, this is for illustrative purposes only and is not intended to be a limitation of this disclosure, as other configurations are possible and are considered to be within the scope of this disclosure. For example and while the at least one propeller drive system may include first outboard motor 24 and at least a second outboard motor (e.g., second outboard motor 26), the at least one propeller drive system may include one or more outdrive systems (not shown). As is known in the art, an outdrive system is the portion of an inboard/outboard propulsion system that is submerged in the water and provides propulsion/steering for the vessel to which it is attached.

Dive platform 22 may be configured to be slidably attached to the at least one hull portion (e.g., first hull portion 18 and second hull portion 20), thus allowing for essentially vertical displacement of dive platform 22 with respect to the at least one hull portion (e.g., first hull portion 18 and second hull portion 20). Accordingly, dive platform 22 may be configured to be essentially vertically displaced (i.e., upward or downward in the direction of arrow 28), so that dive platform 22 may be positioned above/below/proximate the surface of body of water 14 in which boat 12 is floating.

Figure 2:
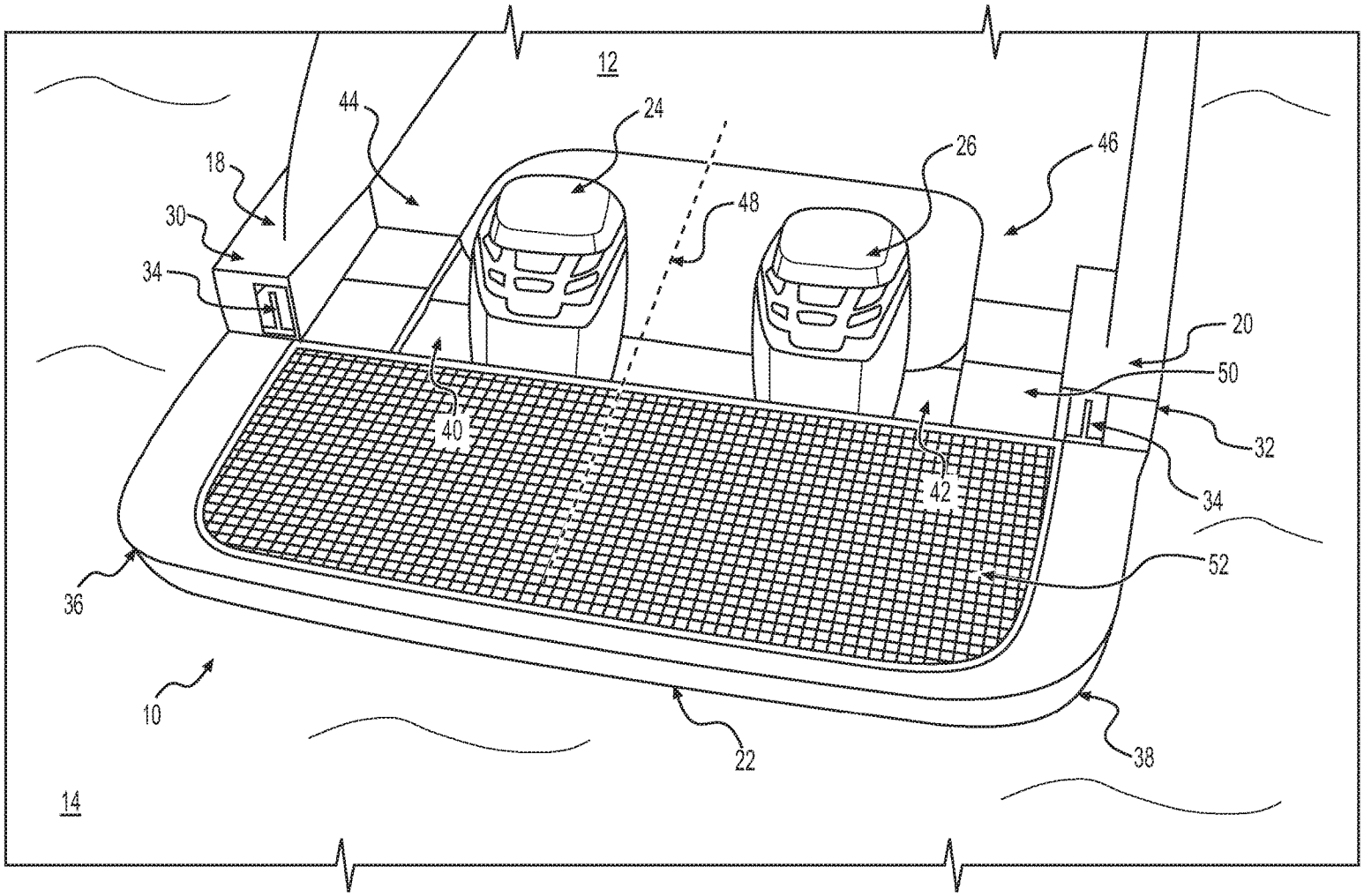
FIG. 2 is a perspective view of the aft-mounted dive platform system in an intermediate position.
Figure 3:
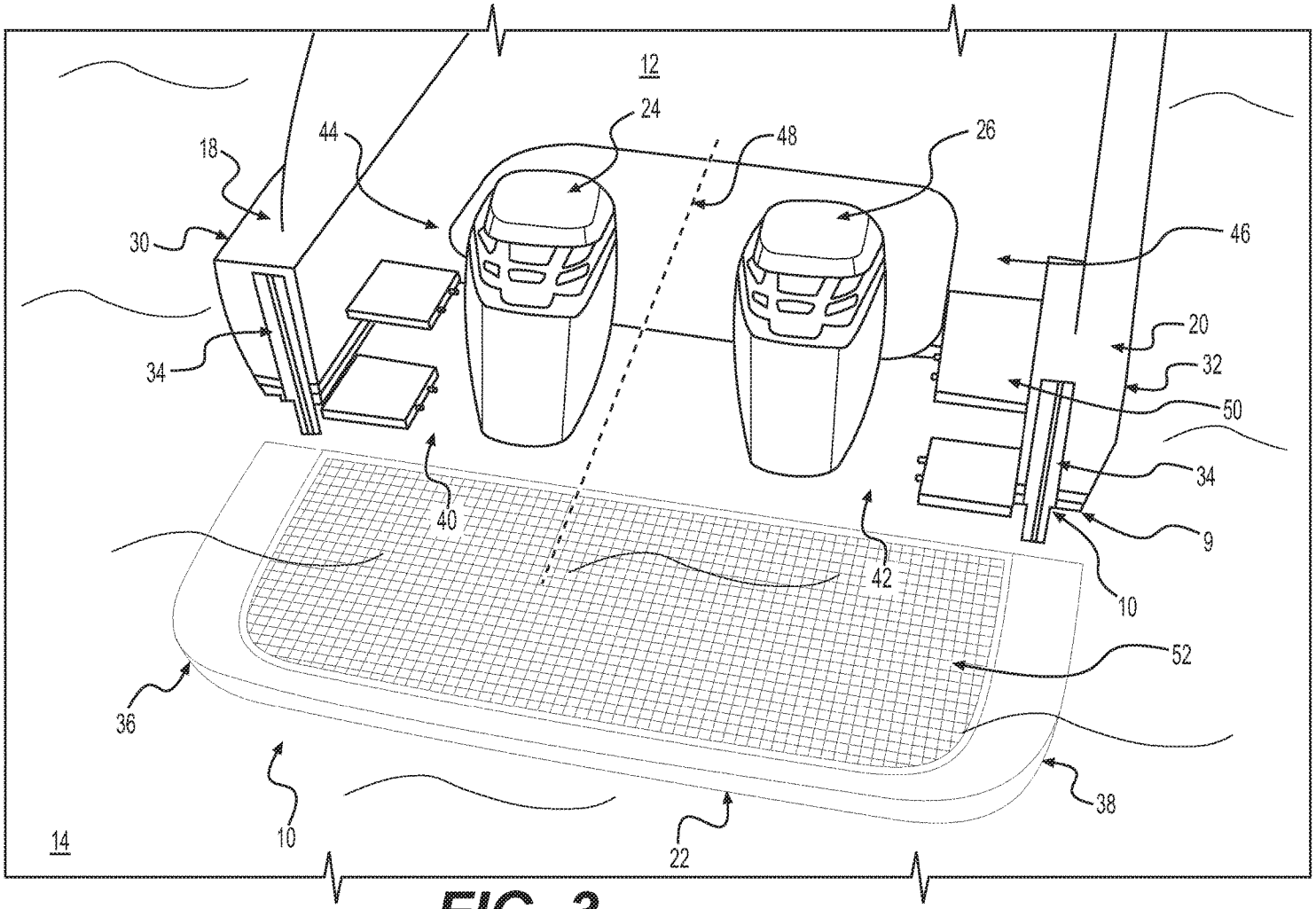
FIGS. 3-4 are perspective views of the aft-mounted dive platform system in a fully-lowered position.
Figure 4:
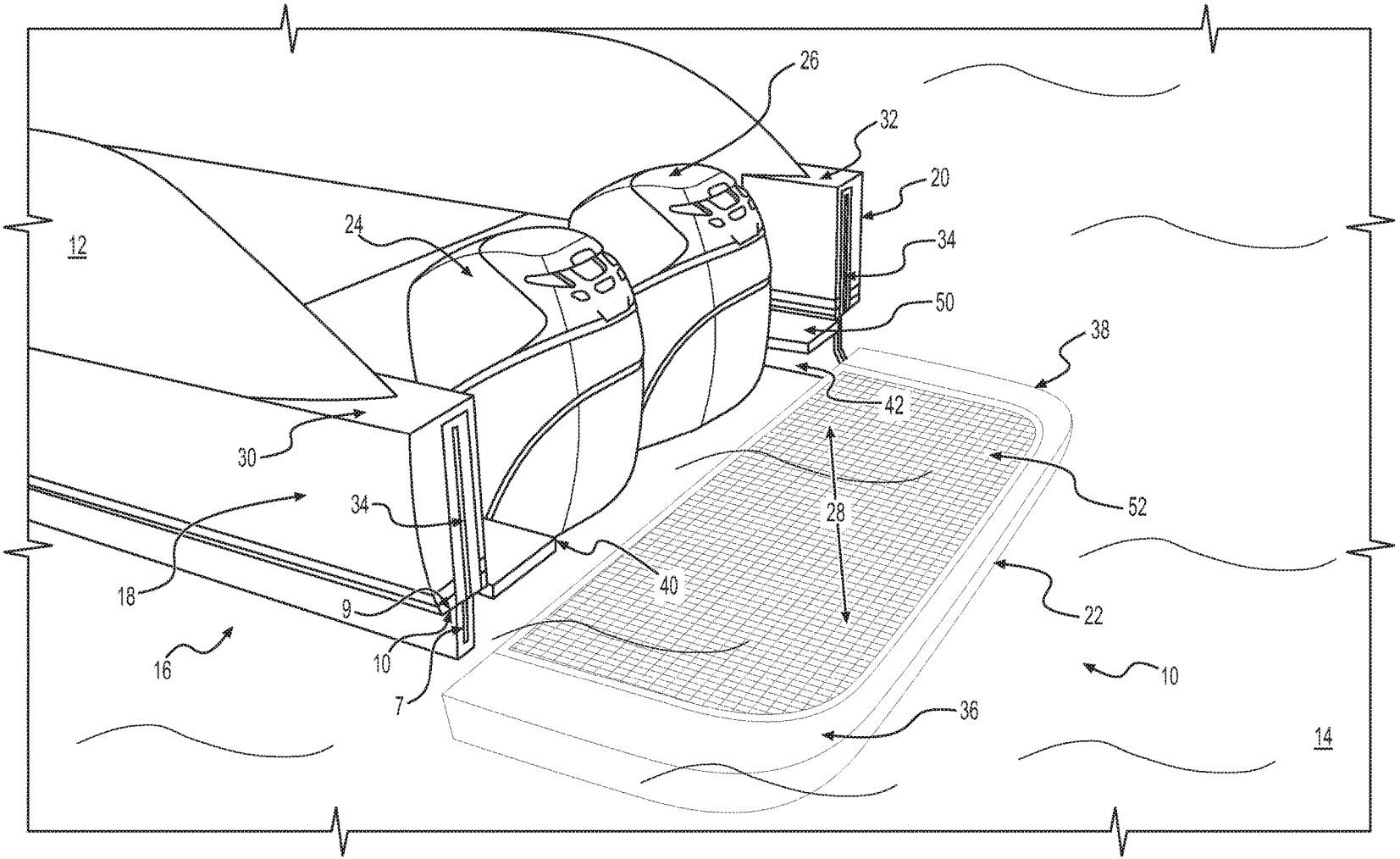
Figure 5:
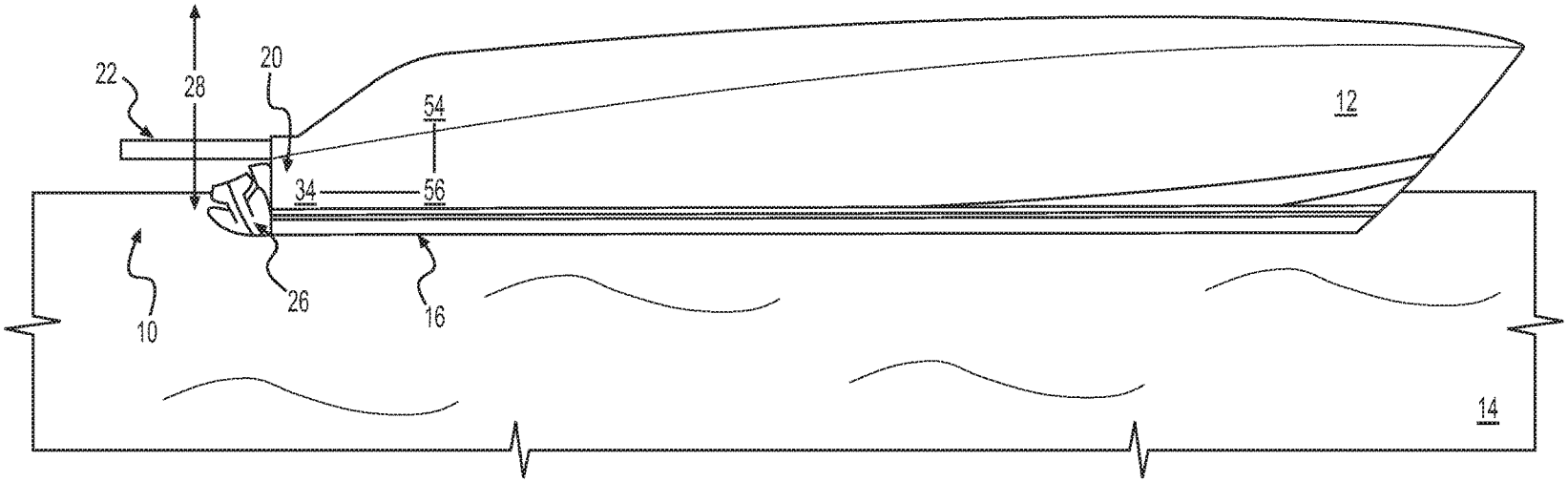
FIG. 5 is a side view of the aft-mounted dive platform system in the fully-raised position.
Figure 6:
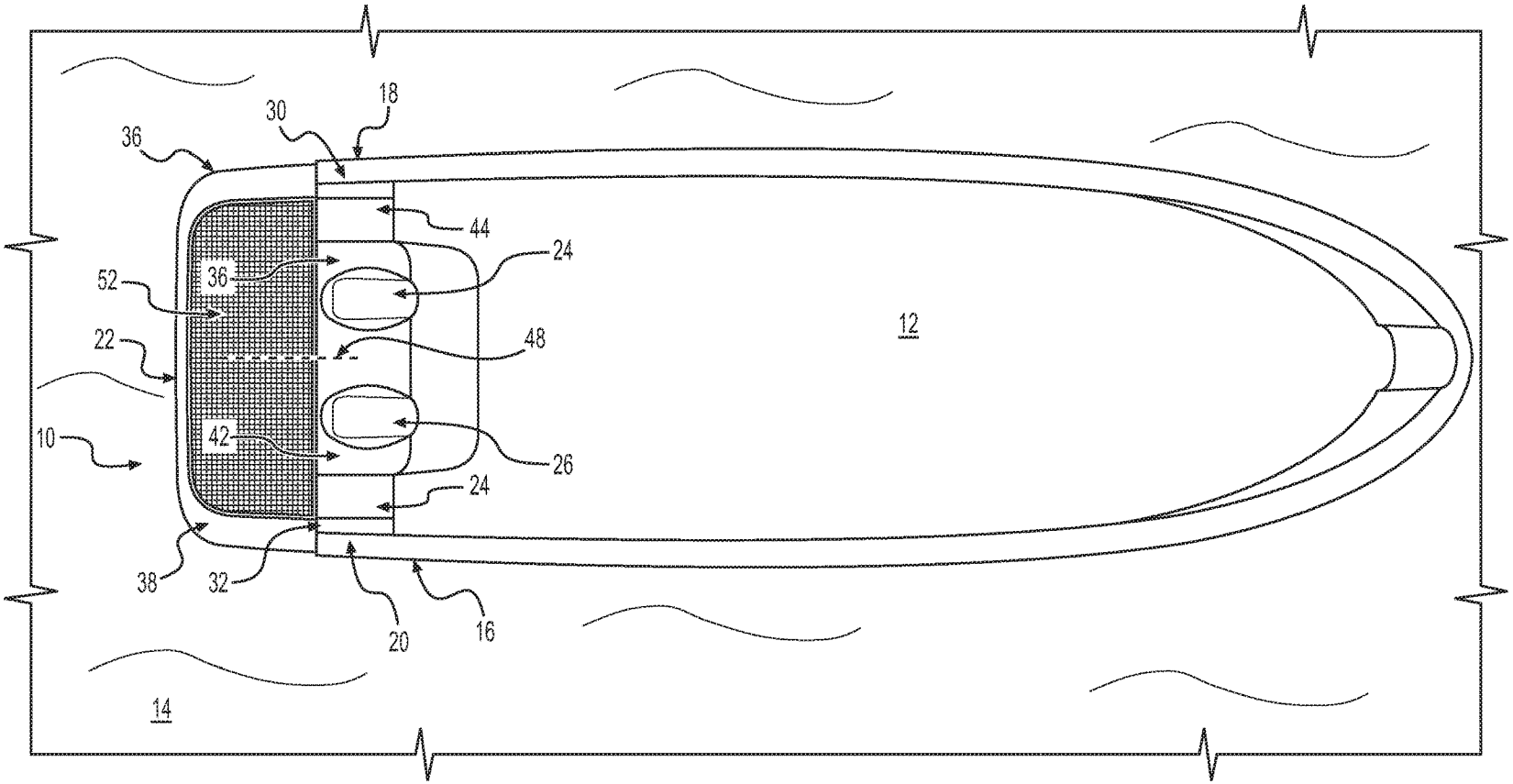
FIG. 6 is a top view of the aft-mounted dive platform system in the fully-raised position.

Accordingly, dive platform 22 may be configured to be positionable at e.g., a) a fully-raised position (as shown in FIGS. 1 & 5); b) at least one intermediate position (as shown in FIG. 2); and c) a fully-lowered position (as shown in FIGS. 3 & 4).

FULLY-RAISED POSITION: The fully-raised position (as shown in FIGS. 1 & 5) may be configured to position dive platform 22 significantly above the surface of body of water 14 in which boat 12 is positioned (e.g., to a level such that the surface of dive platform 22 is even with upper surfaces 30, 32 of hull portions 18, 20 (respectively). When dive platform 22 is in this fully-raised position, first outboard motor 24 and second outboard motor 26 may be rotated (as shown in FIG. 5) to raise the propellers of first outboard motor 24 and second outboard motor 26 out of body of water 14 to e.g., allow for a beach landing of boat 12 or to allow for the use of boat 12 within shallow water.

INTERMEDIATE POSITION: The intermediate position (as shown in FIG. 2) may be configured to position dive platform 22 nominally above the surface of body of water 14 in which boat 12 is positioned. When dive platform 22 is in this intermediate position, this may be considered the "normal" position, as dive platform 22 may be in this intermediate position when boat 12 is travelling within body or water 14 or docked (thus allowing easy ingress and egress of boat 12).

FULLY-LOWERED POSITION: The fully-lowered position (as shown in FIGS. 3 & 4) may be configured to position dive platform 22 below (e.g., by 10 centimeters) the surface of body of water 14 in which boat 12 is positioned. When dive platform 22 is in this fully-lowered position, dive platform 22 may allow for passengers of boat 12 to easily enter and exit body of water 14.

Aft-mounted dive platform system 10 may include actuation system 34 that may be configured to effectuate the essentially vertical displacement (in the direction of arrow 28) of dive platform 22 with respect to the at least one hull portion (e.g., first hull portion 18 and second hull portion 20). Actuation system 34 may be any combination of: an electric actuation system; a hydraulic actuation system; and a pneumatic actuation system, wherein actuation system 34 may be included within the at least one hull portion (e.g., first hull portion 18 and second hull portion 20).

The at least one hull portion (e.g., first hull portion 18 and second hull portion 20) may be configured to position at least a portion of dive platform 22 behind the at least one propeller drive system (e.g., first outboard motor 24 and second outboard motor 26). For example, first hull portion 18 may be positioned proximate first side 36 of dive platform 22, while second hull portion 20 may be positioned proximate second side 38 of dive platform 22. Additionally, first hull portion 18 may be positioned proximate first side 40 of the at least one propeller drive system (e.g., first outboard motor 24 and second outboard motor 26), while second hull portion 20 may be positioned proximate second side 42 of the at least one propeller drive system (e.g., first outboard motor 24 and second outboard motor 26).

As shown in FIGS. 1-4 & 6, the combination of first hull portion 18, second first hull portion 20 and dive platform 22 may be configured to at least partially surround the at least one propeller drive system (e.g., first outboard motor 24 and second outboard motor 26). Many advantages may be achieved with such a configuration, such as A) enhanced safety for the bathers and swimmers at the stern of the boat by keeping the legs and/or extremities of the bathers and swimmers far away from the propellers of e.g., first outboard motor 24 and second outboard motor 26 (thus reducing the risk of death or heavy injury); B) easier access to body of water 14 from boat 12, thus enabling easier swimming, fishing, tubing, etc.; C) easier boarding of boat 12 from e.g., a dock (not shown); and D) an increase in the useful deck space of boat 12.

Passages 44, 46 may be formed proximate hull portions 18, 20 (respectively) by positioning first outboard motor 24 and second outboard motor 26 toward the longitudinal centerline (e.g., centerline 48) of boat 12, thus allowing for safe and easy movement between the main passenger area of boat 12 and dive platform 22 (regardless of the position of dive platform 22). One or more steps (e.g., steps 50) may be included within passage 44 and/or passage 46, wherein steps 50 may be fixed, may be movable, may be foldable and/or may be independently adjustable./foldable.

One or more railings (not shown) may be mounted to dive platform 22 and may be utilized to protect outboard motors 24, 26 and/or may prevent the passengers from falling/stepping into the gaps between first outboard motor 24 and second outboard motor 26 and dive platform 22. Additionally, a sunbed or seats (not shown) may be configured to cover/span first outboard motor 24 and second outboard motor 26, thus providing more usable space on dive platform 22.

As discussed above, in the fully-lowered position (as shown in FIGS. 3 & 4), dive platform 22 may be positioned below (e.g., by 10 centimeters) the surface of body of water 14. In order to aide in the descent of dive platform 22 into body of water 14 and the ascent of dive platform 22 out of body of water 14, dive platform 22 may be configured to allow for the vertical passage of water through dive platform 22. For example, at least a portion of dive platform 22 may be constructed of a water permeable grate structure that may be configured to allow for the vertical passage of water through dive platform 22. For example, dive platform 22 may include at least one clearance panel (e.g., clearance panel 52), wherein this clearance panel may be constructed of a water permeable grate structure that may allow for the passage of water.

Clearance panel 52 may be configured to allow access to the at least one propeller drive system (e.g., first outboard motor 24 and second outboard motor 26) in the event that the at least one propeller drive system (e.g., first outboard motor 24 and second outboard motor 26) needs to be serviced. For example, if one or more of outboard motors 24, 26 need to have their propellers replaced, the service technician may be able to remove clearance panel 52 to gain access to first outboard motor 24 and/or second outboard motor 26.

Additionally, clearance panel 52 may be configured to be displaced in the event that the at least one propeller drive system (e.g., first outboard motor 24 and second outboard motor 26) rotates upward due to running aground. For example, in the event that boat 12 is in shallow water and first outboard motor 24 and/or second outboard motor 26 strikes ground or an underwater obstacle, first outboard motor 24 and/or second outboard motor 26 may include safety features (not shown) that may allow first outboard motor 24 and/or second outboard motor 26 to rotate first outboard motor 24 and/or second outboard motor 26 upward and out of body of water 14 (as shown in FIG. 5). Accordingly, clearance panel 52 may be configured to be physically displaced in the event that the at least one propeller drive system (e.g., first outboard motor 24 and second outboard motor 26) rotates upward due to running aground and strikes clearance panel 52.

As discussed above, when dive platform 22 is in the fully-raised position, first outboard motor 24 and second outboard motor 26 may be rotated (as shown in FIG. 5) to raise the propeller of first outboard motor 24 and second outboard motor 26 out of body of water 14 to e.g., allow for a beach landing of boat 12 or to allow for the use of boat 12 within shallow water, wherein rotation system 54 may be utilized by the captain of boat 12 to rotate first outboard motor 24 and second outboard motor 26 upward or downward.

Accordingly and in order to prevent accidental damage to dive platform 22, aft-mounted dive platform system 10 may include interface system 56 that may be configured to couple actuation system 34 with rotation system 54 for the at least one propeller drive system (e.g., first outboard motor 24 and second outboard motor 26). Accordingly and in the event that rotation system 54 is utilized to rotate first outboard motor 24 and second outboard motor 26 out of body of water 14, interface system 56 may sense this upward rotation and may be configured to effectuate the positioning of dive platform 22 into the fully-raised position.

Figure 7:
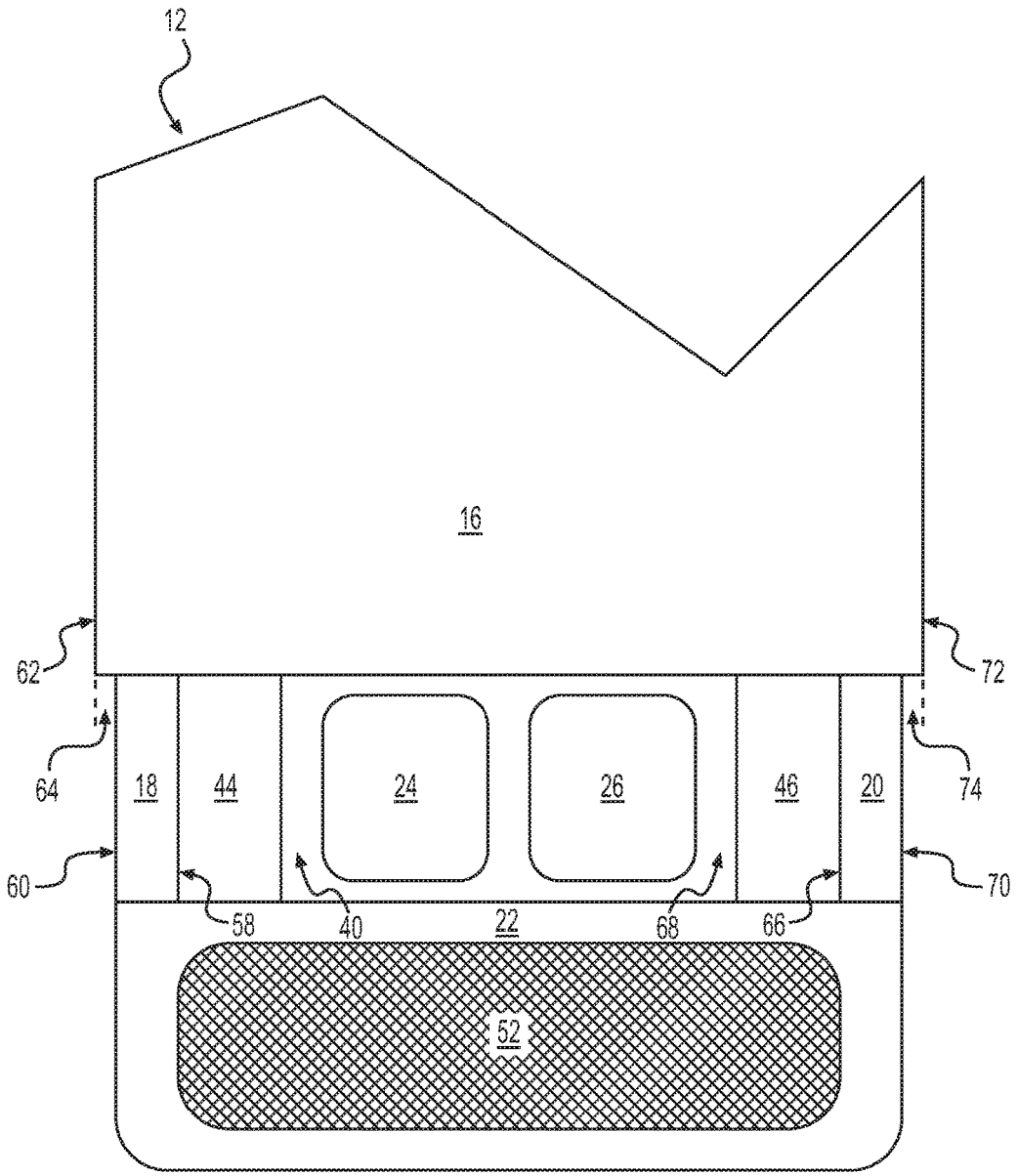
FIG. 7 is a diagrammatic top view of the aft-mounted dive platform system in the fully-raised position.

Referring also to FIG. 7, first hull portion 18 may include first inner portion surface 58 positioned proximate first side 40 of the at least one propeller drive system (e.g., first outboard motor 24 and second outboard motor 26) and first outer portion surface 60 positioned proximate first outer surface 62 of hull 16 of boat 12. First outer portion surface 60 of first hull portion 18 may be recessed with respect to first outer surface 62 of hull 16 of boat 12. For example and in order to ensure good performance at speed and the appropriate hydrodynamic shape of hull 16 at the stern of boat 12, first outer portion surface 60 of first hull portion 18 may be recessed towards the longitudinal centerline of boat 12 in order to create step 64 (e.g., having a width of 3-5 centimeters), so as to allow the flow of water to be detached from first outer surface 62 of hull 16 and enable good maneuvering and turning at speed.

Further, second hull portion 20 may include second inner portion surface 66 positioned proximate second side 68 of the at least one propeller drive system (e.g., first outboard motor 24 and second outboard motor 26) and second outer portion surface 70 positioned proximate second outer surface 72 of hull 16 of boat 12. Second outer portion surface 70 of second hull portion 20 may be recessed with respect to second outer surface 72 of hull 16 of boat 12. For example and in order to ensure good performance at speed and the appropriate hydrodynamic shape of hull 16 at the stern of boat 12, second outer portion surface 70 of second hull portion 20 may be recessed towards the longitudinal centerline of boat 12 in order to create step 74 (e.g., having a width of 3-5 centimeters), so as to allow the flow of water to be detached from second outer surface 72 of hull 16 and enable good maneuvering and turning at speed.

Figure 8A:
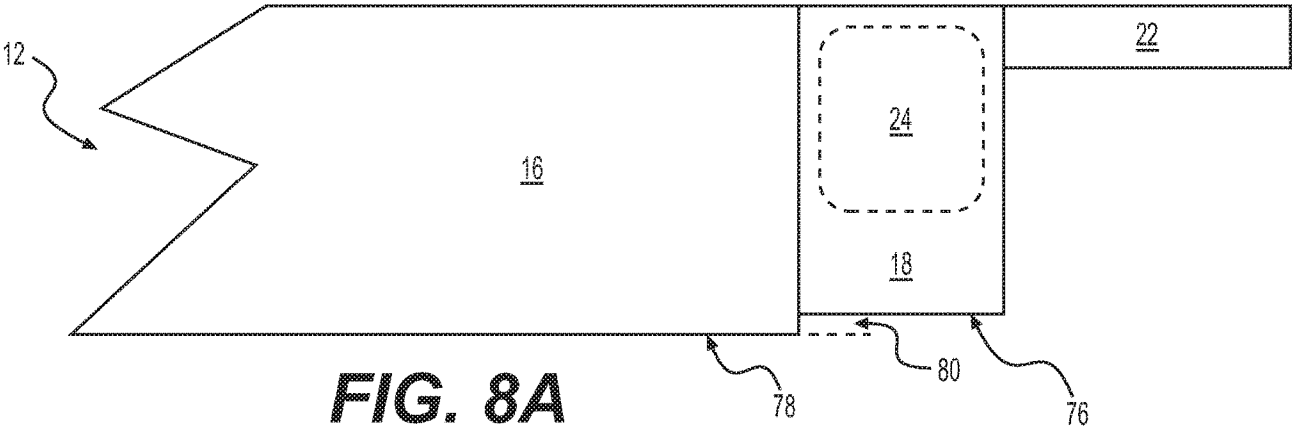
FIGS. 8A & 8B are diagrammatic side views of the aft-mounted dive platform system in the fully-raised position.

Referring also to FIG. 8A, hull portions 18, 20 may be configured to form a similar step with respect to the lower surfaces of hull 16 of boat 12. For example, first hull portion 18 may further include first lower portion surface 76 positioned proximate first bottom surface 78 of hull 16 of boat 12, wherein first lower portion surface 76 of first hull portion 18 may be recessed with respect to first bottom surface 78 of hull 16 of boat 12 to form step 80 (having a height of 3-5 centimeters), so as to allow the flow of water to be detached from first bottom surface 78 of hull 16 of boat 12 and enable good maneuvering and turning at speed.

Figure 8B:
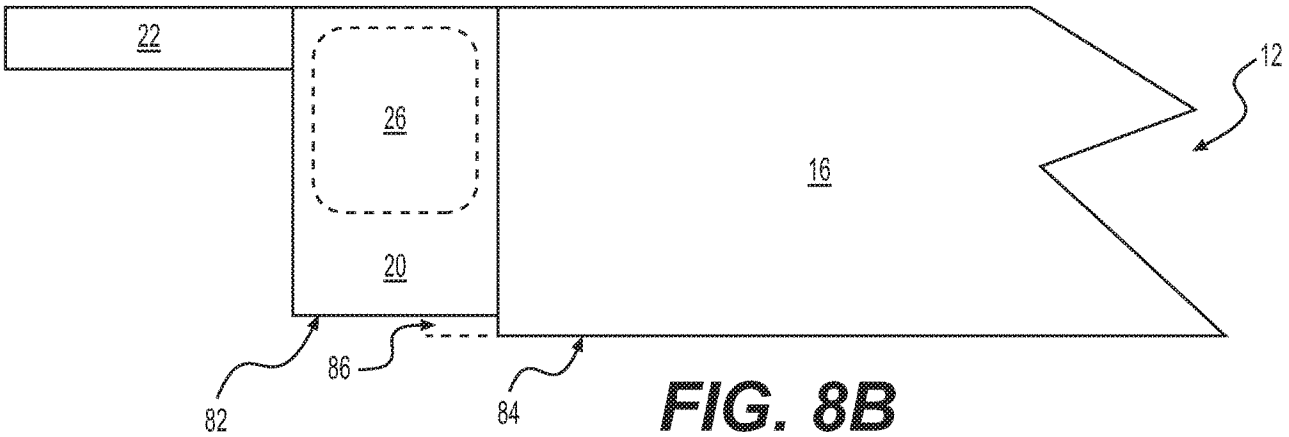

And referring also to FIG. 8B, second hull portion 20 may further include second lower portion surface 82 positioned proximate second bottom surface 84 of hull 16 of boat 12, wherein second lower portion surface 82 of second hull portion 20 may be recessed with respect to second bottom surface 84 of hull 16 of boat 12 to form step 86 (having a height of 3-5 centimeters), so as to allow the flow of water to be detached from second bottom surface 84 of hull 16 of boat 12 and enable good maneuvering and turning at speed.

General:

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

A number of implementations have been described. Having thus described the disclosure of the present application in detail and by reference to embodiments thereof, it will be apparent that modifications and variations are possible without departing from the scope of the disclosure defined in the appended claims.

What is claimed is:

1. An aft-mounted dive platform system comprising:

at least one hull portion rigidly affixed to a hull of a boat; and a dive platform coupled to the at least one hull portion and positioned, at least partially, behind at least one propeller drive system affixed to the stern of the boat;

wherein the at least one hull portion includes: a first hull portion and a second hull portion; and wherein the first hull portion includes: a first inner portion surface positioned proximate a first side of the at least one propeller drive system and a first outer portion surface positioned proximate a first outer surface of the hull of the boat; wherein the first outer portion surface of the first hull portion is recessed with respect to the first outer surface of the hull of the boat providing a step between the first hull portion and the hull of the boat allowing a flow of water to be detached from the first out surface of the hull of the boat.

2. The aft-mounted dive platform system of claim 1 wherein the dive platform is configured to be slidably attached to the at least one hull portion, thus allowing for essentially vertical displacement of the dive platform with respect to the at least one hull portion.

3. The aft-mounted dive platform system of claim 1 wherein the first hull portion is positioned proximate a first side of the dive platform.

4. The aft-mounted dive platform system of claim 1 wherein the first hull portion is positioned proximate a first side of the at least one propeller drive system.

5. The aft-mounted dive platform system of claim 1 wherein the first hull portion further includes:

a first lower portion surface positioned proximate a first bottom surface of the hull of the boat.

6. The aft-mounted dive platform system of claim 5 wherein the first lower portion surface of the first hull portion is recessed with respect to the first bottom surface of the hull of the boat.

7. The aft-mounted dive platform system of claim 1 wherein the second hull portion is positioned proximate a second side of the dive platform.

8. The aft-mounted dive platform system of claim 1 wherein the second hull portion is positioned proximate a second side of the at least one propeller drive system.

9. The aft-mounted dive platform system of claim 1 wherein the second hull portion includes:

a second inner portion surface positioned proximate a second side of the at least one propeller drive system; and a second outer portion surface positioned proximate a second outer surface of the hull of the boat.

10. The aft-mounted dive platform system of claim 9 wherein the second outer portion surface of the second hull portion is recessed with respect to the second outer surface of the hull of the boat.

11. The aft-mounted dive platform system of claim 9 wherein the second hull portion further includes:

a second lower portion surface positioned proximate a second bottom surface of the hull of the boat.

12. The aft-mounted dive platform system of claim 11 wherein the second lower portion surface of the second hull portion is recessed with respect to the second bottom surface of the hull of the boat.

13. The aft-mounted dive platform system of claim 1 wherein the at least one propeller drive system is a portion of an outboard motor.

14. The aft-mounted dive platform system of claim 1 wherein the at least one propeller drive system is an outdrive system.

15. The aft-mounted dive platform system of claim 1 wherein the dive platform is configured to allow for the vertical passage of water through the dive platform.

16. The aft-mounted dive platform system of claim 15 wherein at least a portion of the dive platform is constructed of a water permeable grate structure that is configured to allow for the vertical passage of water through the dive platform.

17. An aft-mounted dive platform system comprising:

at least one hull portion rigidly affixed to a hull of a boat; and a dive platform coupled to the at least one hull portion and positioned, at least partially, behind at least one propeller drive system affixed to the stern of the boat;

wherein the at least one hull portion includes: a first hull portion and a second hull portion;

wherein the first hull portion includes: a first inner portion surface positioned proximate a first side of the at least one propeller drive system and a first outer portion surface positioned proximate a first outer surface of the hull of the boat; wherein the first outer portion surface of the first hull portion is recessed with respect to the first outer surface of the hull of the boat;

wherein the second hull portion includes: a second inner portion surface positioned proximate a second side of the at least one propeller drive system and a second outer portion surface positioned proximate a second outer surface of the hull of the boat; wherein the second outer portion surface of the second hull portion is recessed with respect to the second outer surface of the hull of the boat; and wherein the dive platform is configured to be slidably attached to the at least one hull portion, thus allowing for essentially vertical displacement of the dive platform with respect to the at least one hull portion.

18. The aft-mounted dive platform system of claim 17 wherein the first hull portion further includes:

a first lower portion surface positioned proximate a first bottom surface of the hull of the boat, wherein the first lower portion surface of the first hull portion is recessed with respect to the first bottom surface of the hull of the boat.

19. An aft-mounted dive platform system comprising:

at least one hull portion rigidly affixed to a hull of a boat; and a dive platform coupled to the at least one hull portion and positioned, at least partially, behind at least one propeller drive system affixed to the stern of the boat;

wherein the at least one hull portion includes: a first hull portion and a second hull portion;

wherein the first hull portion includes: a first inner portion surface positioned proximate a first side of the at least one propeller drive system and a first outer portion surface positioned proximate a first outer surface of the hull of the boat; wherein:

the first hull portion is positioned proximate a first side of the dive platform, and the first outer portion surface of the first hull portion is recessed with respect to the first outer surface of the hull of the boat; and wherein the second hull portion includes: a second inner portion surface positioned proximate a second side of the at least one propeller drive system and a second outer portion surface positioned proximate a second outer surface of the hull of the boat; wherein:

the second hull portion is positioned proximate a second side of the dive platform, and the second outer portion surface of the second hull portion is recessed with respect to the second outer surface of the hull of the boat.

20. The aft-mounted dive platform system of claim 19 wherein the dive platform is configured to be slidably attached to the at least one hull portion, thus allowing for essentially vertical displacement of the dive platform with respect to the at least one hull portion.

* * * * *